United States Patent [19]

Kunz

[11] 4,204,410

[45] May 27, 1980

[54] STEAM JET REFRIGERATION PLANT

[75] Inventor: Adolf Kunz, Ettlingen, Fed. Rep. of Germany

[73] Assignee: Wiegand Karlsruhe GmbH, Ettlingen, Fed. Rep. of Germany

[21] Appl. No.: 970,369

[22] Filed: Dec. 18, 1978

[30] Foreign Application Priority Data

Dec. 23, 1977 [DE] Fed. Rep. of Germany ..... 2757748

[51] Int. Cl.[2] ..... F25B 1/06

[52] U.S. Cl. ..... 62/500

[58] Field of Search ..... 62/100, 116, 191, 268, 62/500

[56] References Cited

U.S. PATENT DOCUMENTS

| | | | |
|---|---|---|---|
| 1,765,657 | 6/1930 | Coffey | 62/500 |
| 2,112,563 | 5/1938 | Forncrook | 62/500 |
| 2,155,664 | 4/1939 | Kirgan | 62/500 |

FOREIGN PATENT DOCUMENTS

| | | | |
|---|---|---|---|
| 1214438 | 12/1970 | United Kingdom | 62/500 |

*Primary Examiner*—Ronald C. Capossela

*Attorney, Agent, or Firm*—Bucknam and Archer

[57] ABSTRACT

An improvement in steam jet cooling apparatus for cooling liquids, the apparatus being of the type in which a steam jet compressor, expansion chamber and condensation chamber are arranged in a common horizontally extending vessel that is divided by a partition into the expansion and condensation chambers with the steam jet compressor extending through such partition into both chambers. The improvement provides a manifold inside the vessel for the inlet of the liquid to be cooled which manifold is above the steam jet compressor and extends generally parallel to the length axis of the vessel, plus a divider plate positioned between the manifold in the steam jet compressor through shield, the steam jet compressor against the liquid flowing out of the manifold.

10 Claims, 5 Drawing Figures

STEAM JET REFRIGERATION PLANT

The invention concerns a steam jet cooling plant for liquids with an expander, to the expansion chamber of which the liquid to be cooled can be fed, and from the expansion chamber of which the cooled liquid can be withdrawn on the underside of the chamber, with at least one steam jet compressor, whose suction side is connected to the expansion chamber, and with a condenser whose condensation chamber is connected to the pressure side of the steam jet compressor.

In known steam jet cooling plants of the above type, the expander, the steam jet compressor and the condenser form each a structural unit which must be installed on the site in a supporting construction and be connected with the other structural units. The expander is arranged in a distance from the condenser and connects with the latter over the steam jet compressor. A disadvantage of the known steam jet cooling plants is, on the one hand their great space requirement and, on the other hand, the relatively great expenditures for the supporting construction. The various parts of the cooling plant are delivered separately and must be assembled on the site. Elaborate are also the thermal insulation and the sound insulation since relatively large tanks and large surfaces must be insulated. Finally the great number of flanged joints between the various parts of the plant is a cause of leakages.

The object of the invention is to provide a steam jet cooling plant which can be delivered as a complete unit, requires little space, and works with a low leakage rate.

Starting from a steam jet cooling plant as described above, this problem is solved in this way that the expansion chamber of the expander and the condensation chamber of the condenser are formed by a common tank, which is divided by a partition into the expansion chamber and into the condensation chamber, and that the steam jet compressor is arranged in the tank and protrudes through the partition. The tank contains the principal units of the steam jet cooling plant, and can be prefabricated as a complete unit, so that only the supply lines have to connected on the site, and the assembly operations on the site are thus reduced. Due to the compact design, lighter and simpler supporting constructions can be used. Finally there are no internal flanged connections and no internal pipes, which reduces the leakage rate of the cooling plant. Furthermore, the insulating expenditures for the thermal insulation and the sound insulation are reduced. The steam jet compressor is surrounded by a vacuum on all sides and is thus well sound-proofed.

Relatively compact embodiments are obtained if the tank has a cylindrical form and the steam jet compressor is so arranged that the direction of its jet extends along the cylinder axis. The steam jet compressor contains, in addition to its driving nozzle, a diffusor which increases the pressure of the steam to the pressure necessary for condensation.

The tank can be installed with a vertical or horizontal cylinder axis. With a horizontal installation, however, larger evaporation surfaces inside the expander can be obtained with the same height of the tank. In multi-stage cooling plants, the tanks of the various stages are preferably superposed with a horizontal cylinder axis, because of the lower overall height. The dividing plate prevents the steam jet compressor from carrying along the liquid to be cooled. It extends preferably in an arc around the part of the steam jet compressor arranged inside the expansion chamber down to its bottom edge. This way a hood is obtained which forms inside the expansion chamber a separation chamber in which the vapors separated from the cooled liquid and deposited on the bottom of the expansion chamber can be separated from the cold water and sucked off by the steam jet compressor. In combination with a manifold for the liquid to be cooled, which extends preferably parallel to the cylinder axis, the dividing plate ensures the uniform distribution of the liquid in the expansion chamber.

Preferably at least one baffle plate projects upward from the bottom of the expansion chamber. The baffle plate deflects the vapors from the surface of the cooled liquid away to the steam jet compressor and limits thus at the same time the velocity of flow of the vapors.

Depending on the field of application, the condenser can be designed as a mixing condenser or as a tubular condenser. In mixing condensers, the cooling liquid is supplied preferably over a manifold provided with outlet nozzles above the parts of the steam jet compressor protruding into the condensation chamber and is deflected from the walls into the interior of the condensation chamber so that the contact time between the cooling liquid and the vapor driving-steam mixture supplied over the steam jet compressor is increased.

Usually the steam jet compressor extends over the entire axial length of the tank. In front of the steam outlet opening of the steam jet compressor is therefore preferably arranged in a distance thereof a baffle which deflects the vapor driving steam mixture issuing from the steam jet compressor into the opposite direction. In tubular condensers, embodiments were found to be suitable where the cooling liquid pipes are arranged parallel to the direction of the jet of the steam jet compressor.

Embodiments of the invention will now be described more fully below with references to the drawings.

Figure 1:
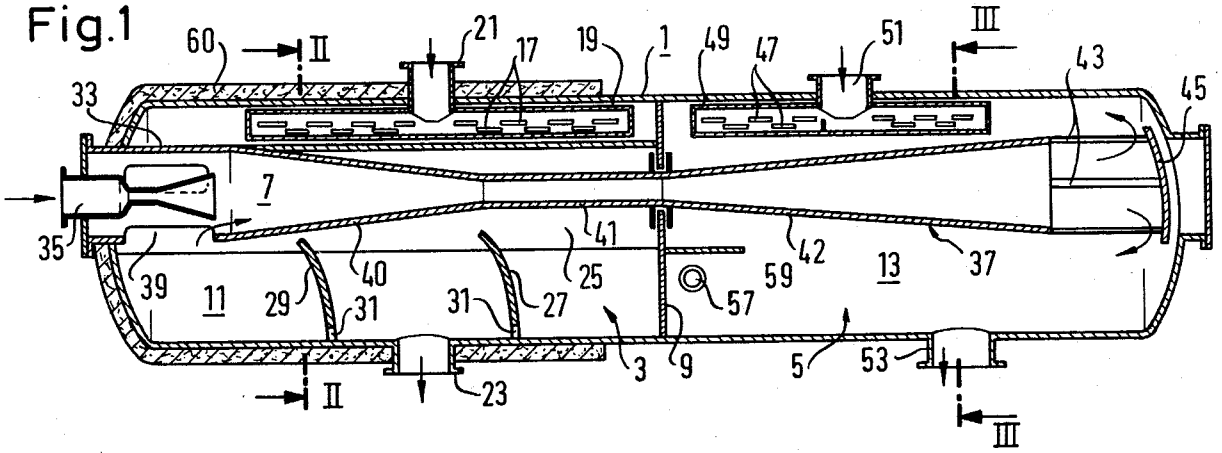
FIG. 1 shows a schematic longitudinal section through a steam jet cooling plant with mixing condenser.
Figure 2:
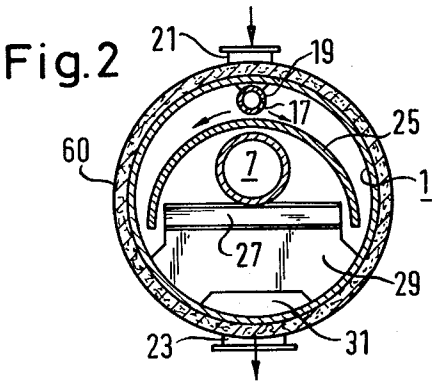
FIG. 2 shows a cross section through the cooling plant according to FIG. 1 along line II—II.
Figure 3:
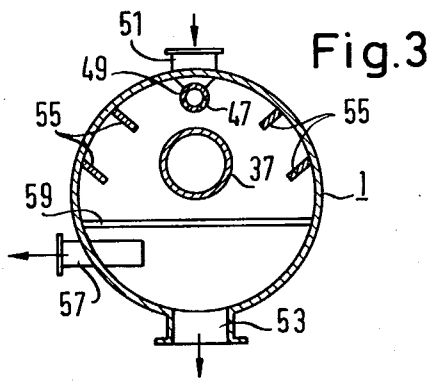
FIG. 3 shows a cross section through the cooling plant according to FIG. 1 along line III—III.

FIGS. 1 to 3 show a steam jet cooling plant installed in a cylindrical tank 1, with an expander 3, a mixing condenser 5, and a steam jet compressor 7. A partition 9 extending transverse to the cylinder axis of tank 1 subdivides tank 1 into an expansion chamber 11 and into a condensation chamber 13. In expansion chamber 11 the liquid to be cooled is subjected to a pressure which is lower than its steam pressure, so that it comes to a boil and cools off by evaporation cooling. The vacuum in expansion chamber 11 is produced by means of steam jet compressor 7 which sucks off the steam of the liquid to be cooled at a low pressure and compresses it to such a pressure that condensation at the cooling liquid temperature of mixing condenser 5 is possible.

The liquid to be cooled is introduced over a plurality of outlet openings 17 of a manifold 19 into expansion chamber 11. Manifold 19 is arranged on the top side of expansion chamber 11 and extends parallel to the horizontal cylinder axis of tank 1; it is connected to a pipe connection 21 leading to the outside. The cooled water accumulates on the bottom of expansion chamber 11 and is withdrawn through pipe connection 23. Over the entire length of the part of steam compressor 7 arranged in expansion chamber 11 extends a curved hood-shaped dividing plate 25 which embraces steam jet compressor 7 down to its bottom edge. Dividing plate 25 distributes the liquid issuing from manifold 19 and divides expansion chamber 11 into an evaporation area above dividing plate 25 and into a deposit area below dividing plate 25 in which the vapors evaporated from the cooled liquid on the bottom of the expansion chamber 11 can be sucked off by means of steam jet compressor 7. From the bottom of expansion chamber 11 project deflecting plates 27, 29 which reduce the velocity of flow of the vapors parallel to the liquid surface by deflecting the vapors upward. This way the detachment of liquid droplets by the vapor flowing along the liquid surface can be reduced. Openings 31 provided on the underside of deflecting plates 27, 29 permits the withdrawal of the cooled liquid.

Steam jet compressor 7 comprises a driving nozzle 35 arranged in a nozzle tip 33 as well as a diffusor 37 adjoining driving nozzle 35, which consists of an inlet cone 40 facing the driving nozzle as neck 41 adjoining inlet cone 40, and an outlet cone 42. Diffusor 37 traverses partition 9 and is sealed from the latter. The steam fed to driving nozzle 35 expandsadiabatically in the latter. The steam jet issuing from driving nozzle 35 carries along the vapors evaporated from the liquid to be cooled through openings 39 of nozzle tip 33 and accelerates them. The vapor driving steam mixture is mixed in inlet cone 40 and compressed in restrictor-shaped neck 41. Ahead of the outlet nozzle of diffusor 37 opening into condensation chamber 13 is arranged by means of holder 43 a curved, likewise flat baffle 45, which prevents a hard and noisy impact of the jet on the tank bottom.

Parallel to the cylinder axis of tank 1 is arranged on the top side of condensation chamber 13 a manifold 49 provided with outlet nozzles, e.g. in slot-form, to which is fed a cooling liquid through a pipe connection 51 leading to the outside. The cooling liquid issuing from manifold 49 mixes with the vapor driving steam mixture issuing from diffusor 37 and cools the latter. The condensate and the cooling liquid are withdrawn over a pipe connection 53 on the bottom of condensation chamber 13. Deflection plates 55 arranged on the side walls of condensation chamber 13 distribute the cooling liquid fed from manifold 49 to the interior of condensation chamber 13. For ventilation condensation chamber 13 is provided a vent connection 57 which is protected by a roof 59 against the cooling liquid trickling down from the top. For heat insulating the part of tank 1 containing expension chamber 11 is covered with insulating material. The expander and the condenser are insulated for sound insulation.

Figure 4:
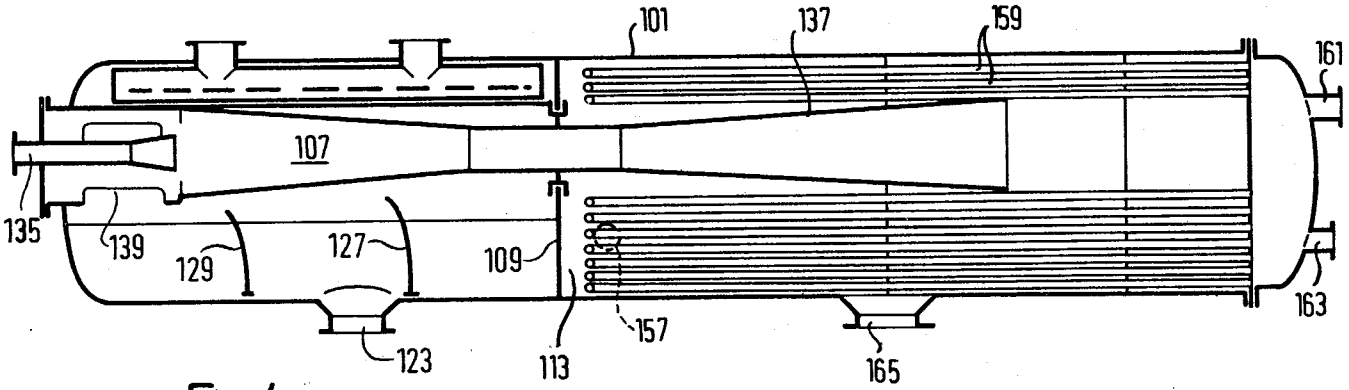
FIG. 4 shows a schematic longitudinal section through a steam jet cooling plant with tubular condenser and FIG. 5 shows a schematic sketch of a three-stage steam jet cooling plant which is built by using the cooling plants according to FIG. 1

FIG. 4 shows another embodiment of a steam jet cooling plant, which differs from the cooling plant shown in FIGS. 1 to 3 substantially only by the type of the condenser. Parts with a similar function will therefore be provided with reference numbers increased by 100. The cooling plant according to FIG. 4 has a tubular condenser, which contains in its condensation chamber 113 a plurality of hairpin-pipes 159 which can be connected over pipe connections 161 and 163 resp. to a liquid cycle. Hairpins 159 extend parallel to the cylinder axis of housing 101. The vapor/driving steam mixture issuing from a diffusor 137 of a steam jet compressor 107 condenses on hairpin pipes 159. The condensate is withdrawn over a pipe connection 165 on the bottom of tank 101. A vent connection 157 is provided for ventilating condensation chamber 113.

Figure 5:
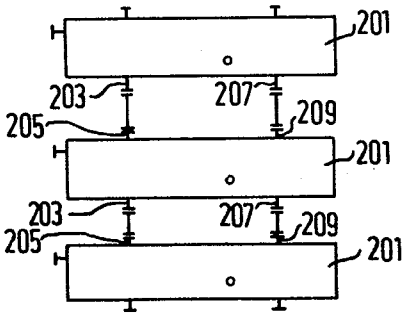

FIG. 5 shows in a sketch how the cooling plants according to FIGS. 1 to 4 can be combined to a multistage steam jet cooling plant. Tanks 201 are superposed with a horizontal cylinder axis with the outlet pipe connection of one expansion chamber being connected to the inlet pipe connection 205 of an expansion chamber arranged underneath. In the same manner the outlet pipe connection 207 of one condenser is connected to the cooling liquid inlet pipe connection 209 of the condenser underneath. Other connecting methods are also possible.

I claim:

1. In a steam jet cooling apparatus for cooling liquids, including: and expansion chamber into which is fed the liquid to be cooled and out of which is drawn the liquid that has been cooled; at least one steam jet compressor the suction side of which is connected to said expansion chamber; a condensation chamber which is connected to the pressure side of said steam jet compressor; which steam jet compressor, expansion chamber and condensation chamber are arranged in a common, horizontally extending vessel, which vessel is divided by a partition into said expansion chamber and said condensation chamber, the steam jet compressor penetrating and extending through said partition; the improvement which comprises in combination a manifold within said vessel for the inlet of the liquid to be cooled, positioned above said steam jet compressor and extending generally parallel to the longitudinal axis of the vessel; and, a divider plate disposed between the manifold and the steam jet compressor to shield the steam jet compressor against the liquid to be cooled flowing out of the manifold.

2. The improvement according to claim 1 wherein said vessel is generally cylindrical and said steam jet compressor is so positioned that its jet axis extends generally parallel with the longitudinal axis of the vessel.

3. The improvement according to claim 1 wherein the divider plate extends in an arc down to its bottom edges about the part of the steam jet compressor arranged inside said expansion chamber.

4. The improvement according to claim 1 wherein the divider plate extends in the lengthwise direction of the expansion chamber over the full length thereof.

5. The improvement according to claim 1 including at least one deflecting plate projecting upward from the bottom of the expansion chamber.

6. The improvement according to claim 1 including a baffle plate positioned a distance in front of the steam outlet opening of the steam jet compressor.

7. The improvement according to claim 1 including a manifold for the supply of cooling liquid, said manifold being positioned in said condensation chamber and extending generally parallel with the longitudinal axis of the vessel, and being disposed above a part of the steam jet compressor that extends into the condensation chamber.

8. The improvement according to claim 1 wherein said condensation chamber contains a plurality of tubesin heat exchange with the steam discharge of said steam jet compressor.

9. The improvement according to claim 1 wherein said condensation chamber is disposed to receive a cooling liquid for intermixing heat exchange with the steam discharge of said steam jet compressor.

10. The improvement according to claim 1 including sound insulation material covering at least part of said vessel.

* * * * *